US008931640B2

(12) United States Patent
Perot

(10) Patent No.: US 8,931,640 B2
(45) Date of Patent: Jan. 13, 2015

(54) STACKABLE PACKAGING UNIT

(75) Inventor: Frédéric Perot, St Paul de Varces (FR)

(73) Assignee: Becton Dickinson France, S.A.S., Le Pont de Claix (FR)

( * ) Notice: Subject to any disclaimer, the term of this patent is extended or adjusted under 35 U.S.C. 154(b) by 781 days.

(21) Appl. No.: 12/514,373

(22) PCT Filed: Nov. 14, 2007

(86) PCT No.: PCT/IB2007/004292
§ 371 (c)(1),
(2), (4) Date: Dec. 18, 2009

(87) PCT Pub. No.: WO2008/059383
PCT Pub. Date: May 22, 2008

(65) Prior Publication Data

US 2010/0140130 A1 Jun. 10, 2010

(30) Foreign Application Priority Data

Nov. 15, 2006 (FR) ..... 06 09986

(51) Int. Cl.
*B65D 85/62* (2006.01)
*B65D 21/08* (2006.01)

(52) U.S. Cl.
CPC ..... *B65D 21/083* (2013.01); *Y10S 229/918* (2013.01)
USPC ..... 206/509; 206/503; 229/918

(58) Field of Classification Search
USPC ..... 206/519, 503, 509, 508, 511, 512, 520, 206/516; 229/918, 125.27, 915.1, 915, 919
See application file for complete search history.

(56) References Cited

U.S. PATENT DOCUMENTS

| | | | | |
|---|---|---|---|---|
| 4,053,098 | A * | 10/1977 | Baptist | 206/509 |
| 4,567,996 | A * | 2/1986 | Muise | 229/125.17 |
| 6,938,820 | B2 * | 9/2005 | Noone et al. | 229/176 |
| 2003/0150764 | A1 | 8/2003 | Bevier | |
| 2004/0056081 | A1 | 3/2004 | Christensen et al. | |
| 2007/0017843 | A1 * | 1/2007 | Keel et al. | 206/509 |

FOREIGN PATENT DOCUMENTS

| | | | |
|---|---|---|---|
| DE | 11 99 687 | B | 8/1965 |
| DE | 83 29 240 | U1 | 2/1984 |
| DE | 203 07 604 | U1 | 8/2003 |
| EP | 0668220 | A1 | 8/1995 |

* cited by examiner

*Primary Examiner* — Jeffrey Allen
(74) *Attorney, Agent, or Firm* — Hoffmann & Baron, LLP

(57) ABSTRACT

The present invention pertains to a stackable packaging unit (1) for the packaging of products (100), the said packaging unit (1) comprising at least one encircling wall (2) provided at least with a corner ridge (3) dividing it into at least two retaining panels (2*a*) Partially folded down towards one another about the said corner ridge (3) so as to hold the said products (100) to be packaged, at least one end of the said corner ridge (3) being connected to the corresponding edges of the said retaining panels (2*a*) by at least one inclined centring profile. The stackable packaging unit (1) also comprises an intermediate element. The invention also pertains to a packaging comprising at least one such packaging unit (1).

7 Claims, 6 Drawing Sheets

STACKABLE PACKAGING UNIT

Figure 1:
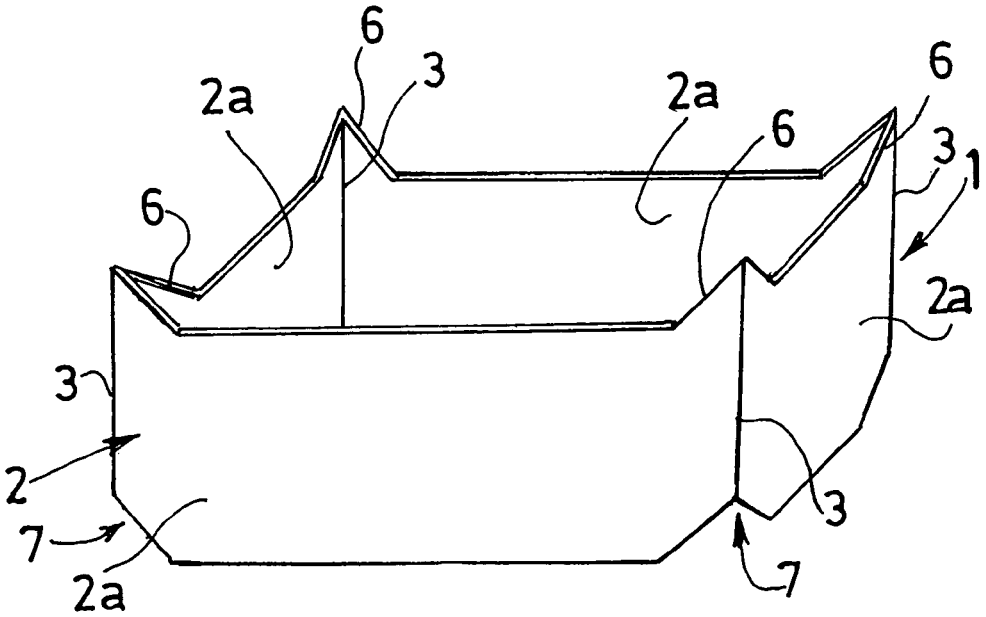

The present invention pertains to a stackable packaging unit for the packaging of products, this packaging unit comprising at least one encircling wall provided at least with a corner ridge dividing it into at least two retaining panels partially folded down towards one another about the corner ridge so as to hold the products to be packaged. The present invention also pertains to an intermediate element for the packaging of products which is intended to be used in combination with the aforesaid packaging unit. The invention pertains finally to a packaging comprising several stacked packaging units associated with intermediate elements, in particular with a view to subsequent palletization.

In numerous industrial fields, the producers and/or suppliers of intermediate products or of fabricated articles are induced to package the said products and/or articles so as to transport them from their place of manufacture to their place of distribution or directly to customers who have ordered the said products and/or articles. When these articles or products are ordered in large quantity, it is important to package them together according to the methods that are most advantageous from an economic and practical point of view for their transport whilst ensuring optimal protection of the products thus packaged and transported.

Thus, in the case of substantially identical products exhibiting nestable or stackable shapes, the products are generally disposed in stacks within packagings. These packagings are generally formed by a paperboard surround defining an enclosure over the entire height of the stacked products. The products thus packaged can be placed on pallets so as to be transported, lifted so as to be loaded and/or unloaded into lorries or containers by means of robots or automatic cranes. Moreover, the said products can also be placed in the enclosures automatically with the aid of machines comprising arms for gripping the said products. Likewise it is particularly advantageous for the products to be able to be destacked automatically. The use of the enclosures generates additional constraints for performing the automatic destacking operations. Specifically, when the enclosure is left in position before destacking, the products have to be destacked, individually or by level, from the top of the enclosure by means of gripping devices of, for example, sucker type. When the enclosure is withdrawn before the destacking operation, the products can then be destacked laterally or from the top, individually or by level. In the latter case, the stacks are unstable and are at risk of falling at any time.

This kind of packaging is for example used in the pharmaceutical or paramedical industry in which one may be induced to transport medical devices (medical containers) from one place to another place some distance away from the first. For example, in the case of the production of pre-filled syringes, the empty syringe bodies must be transported from their place of production to the place of production of the medicinal substances intended to fill the said bodies, these two places of production possibly being quite some distance apart. For this purpose, generally, a plurality of syringe bodies is lodged in housings provided for this purpose within trays that are themselves placed in boxes. These boxes are generally parallelepipedal, of moderate weight and may be relatively voluminous. In view of their fragile content, it is important in particular that they be transported in a very precise position, flat.

The packagings proposed on the market are not always satisfactory as regards the optimization of the automation of the operations of filling and/or unpacking of these packagings. Specifically, the products are not always properly stacked with respect to one another and this may slow down the handling of the packaged products during these operations or worse still cause droppages that are dangerous at one and the same time for the integrity of the packaged products, of their content and for the personnel handling the packagings.

Moreover, the prior art packagings which exhibit a certain volume consequently require a significant working space during the operations of handling, loading and/or unloading these packagings.

Additionally, certain prior art packagings, such as the enclosures described previously, necessitate a predefined stack height of packaged products and do not allow this height to be adapted according to requirements.

Publication US 2004/0 056 081 A1 describes a packaging that can comprise several rectangular shallow crates overlaid one above another. The height of the stack of shallow crates can thus be adapted by varying the number of stacked shallow crates. Each shallow crate comprises, on each of its long sides, two reliefs provided on the upper part and, disposed opposite these reliefs, two slots provided on the lower part. Thus, when several shallow crates are overlaid, the reliefs of the lower shallow crates fit into the slots of the upper shallow crates. The presence of the slots renders the construction of these shallow crates complex. Additionally, to obtain stacking having good stability, it is imperative that the shallow crates be positioned accurately one above the other so that the reliefs fit correctly into the corresponding slots. This accuracy is hardly compatible with the automation of stacking. In addition, in the case of individual destacking of the products, this destacking can be done only from above, hence additional constraints.

Publication US 2003 0 150 764 A1 describes another packaging that can also comprise several rectangular shallow crates overlaid one above the other. In this example, each shallow crate comprises four openings each provided at one of the four corners of its bottom and four corner extensions each provided in the upper alignment of one of the corners of the shallow crate. Thus, when several shallow crates are overlaid, the corner extensions of the lower shallow crates fit into the openings of the upper shallow crates to ensure the stability of stacking. This solution requires as much accuracy as the previous one in respect of the stacking operations. Therefore, this solution nevertheless does not make it possible to facilitate the automation of the stacking of the shallow crates. In addition, in the case of individual destacking of the products, this destacking can only be done from above, hence additional constraints.

Document DE 203 07 604 describes a stackable packaging unit comprising retaining panels and intermediate elements bearing on said panels.

The present invention aims to remedy the problems stated above by proposing a stackable packaging unit making it possible to optimize the operations of handling at one and the same time of the packaged products, of the packagings obtained and of the pallets loaded with such packagings, doing so in particular by facilitating the relative positioning of the stacked packaging units. The packaging unit according to the invention makes it possible to ensure the protection of the packaged products and of their content. The packaging unit according to the invention is moreover adaptable and in particular allows the height of the packaging to be tailored as a function of the requirements and constraints.

A first aspect of the invention is a stackable packaging unit for the packaging of products, the said packaging unit comprising at least one encircling wall provided at least with a corner ridge dividing it into at least two retaining panels partially folded down towards one another about the said corner ridge so as to hold the said products to be packaged, at least one end of the said corner ridge being connected to the corresponding edges of the said retaining panels by at least one inclined centring profile chosen from among a centring ridge defining with the said corner ridge a substantially Y shape whose branches are arranged so as to truncate the corner formed by the intersection between the said corner ridge and the corresponding edges of the said retaining panels, and a centring projection extending the said corner ridge and exhibiting a substantially V shape of substantially complementary shape to that of the said centring ridge, characterized in that said packaging unit further comprises at least one intermediate element comprising at least one substantially plane insert wall of polygonal shape, the said insert wall being intended to be disposed so as to bear against at least one of said centring ridge or centring projection of the said packaging unit, at least one of the corners of said intermediate element comprising at least two linear or point-like centring wedge intended to bear at least in part against at least a part of the said centring ridge or centring projection.

Thus, during the positioning of a packaging unit against an adjacent packaging unit, for example by stacking the packaging units, the centring ridge, respectively the centring projection, of the first packaging unit fits onto the centring projection, respectively the centring ridge of the adjacent packaging unit, permitting perfect self-alignment of the first packaging unit with respect to the adjacent packaging unit. The same thing happens with each addition of a packaging unit against the last packaging unit installed. In the case of stacked packaging units, it is thus possible to obtain a vertical stack whose various packaging units self-centre automatically with respect to one another and are particularly well aligned in a manner centred one above the other. Such a stack makes it possible to guarantee the stability of the stack especially during its transport, and an optimization of the operations for handling the products and the packages. The pallets intended to receive these packages can be loaded and/or unloaded in a more effective and automatic manner.

According to an embodiment of the invention, the intermediate element is manufactured from a material chosen from the group comprising paperboards, plastics and their mixtures. This material may for example be folded along prefold lines.

In an embodiment of the invention, at least one of the said retaining panels is extended by at least one insert wall defining at least in part the said intermediate element.

In an embodiment of the invention, several retaining panels are each extended by at least one insert wall, the said insert walls being arranged so as to completely shut off an opening of the enclosure delimited by the said packaging unit.

Thus, it is possible to define in advance, on the material constituting the unit, prefold lines, according to which it will be possible to fold or to unfold the said packaging unit and/or the said intermediate element. Preferably, these prefold lines correspond to the ridges of the packaging unit.

In an embodiment of the invention, the packaging unit is able to adopt a flattened storage configuration in which at least two of the said retaining panels that are adjacent are folded back towards one another about the said corner ridge separating them.

In particular, in the case where the enclosure formed by the packaging unit forms a square or a rectangle, it is possible to fold the packaging unit on itself along two fold lines corresponding to two opposite corner ridges so as to make the packaging unit adopt a totally flattened configuration. In this flattened storage configuration, the packaging unit takes up particularly little room and allows economy of space.

In an embodiment of the invention, the said intermediate element and the said packaging unit are arranged so that the inclined centring profile of at least one linear centring wedge of the said corner is substantially complementary to the inclined centring profile of one at least of the said centring projection, centring ridge.

A further aspect of the invention is a packaging comprising at least two packaging units as described hereinabove, the said packaging units being adjacent and nested one in another by means of the said centring projection of a first packaging unit lodged against the said centring ridge of a second adjacent packaging unit, at least one intermediate element as described hereinabove being disposed nested between the said first and second adjacent packaging units.

In an embodiment of the invention, the packaging furthermore comprises a cover.

In an embodiment of the invention, the packaging furthermore comprises a transport pallet.

The invention further pertains to an assembly of products disposed in adjacent stacks and packaged by means of a packaging as described hereinabove.

Figure 2:
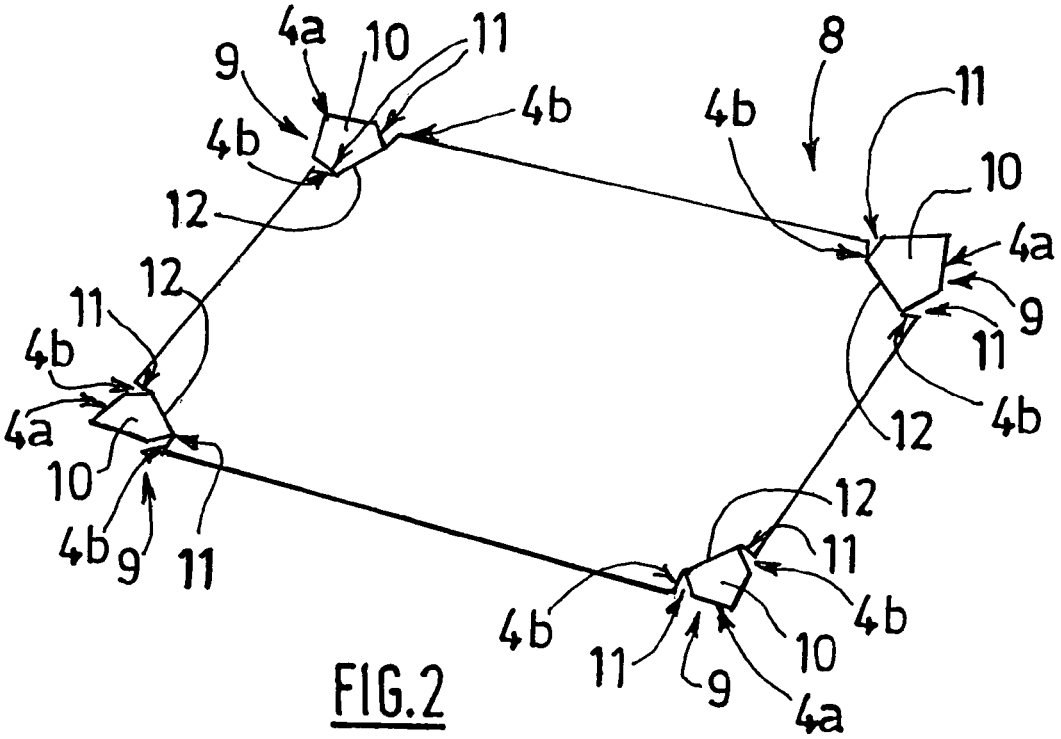
Figure 3:
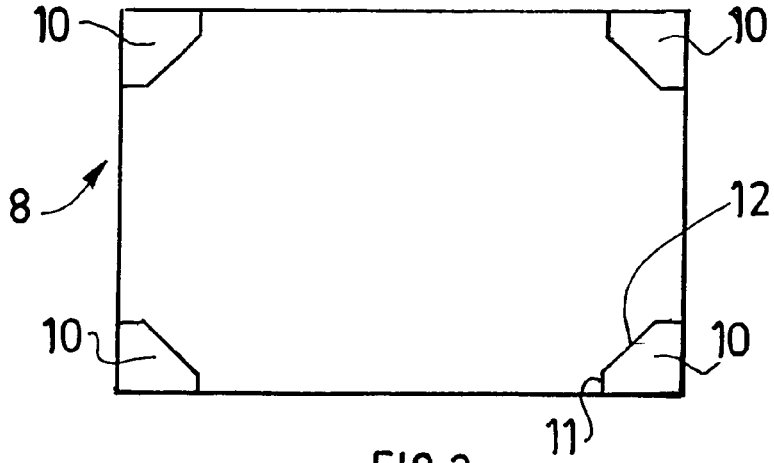
Figure 4:
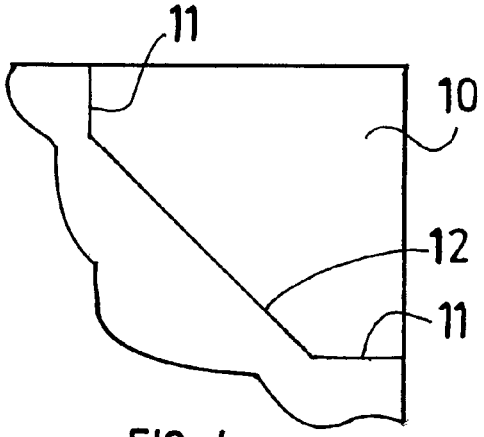
Figure 5A:
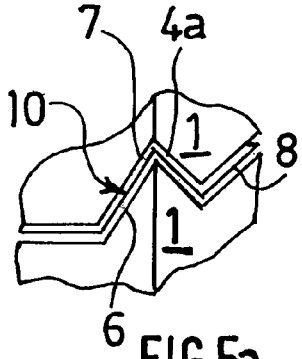
Figure 5B:
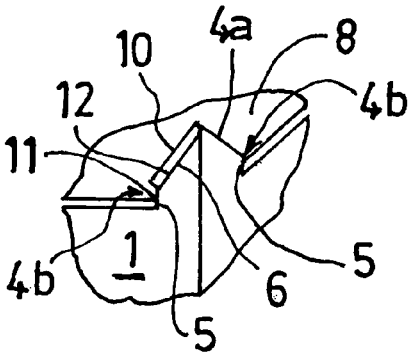
Figure 5C:
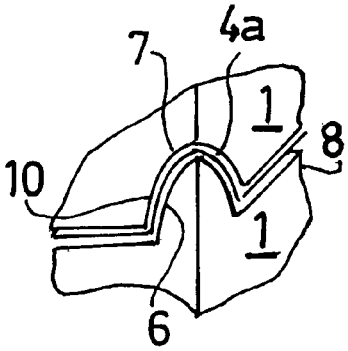
Figure 5:
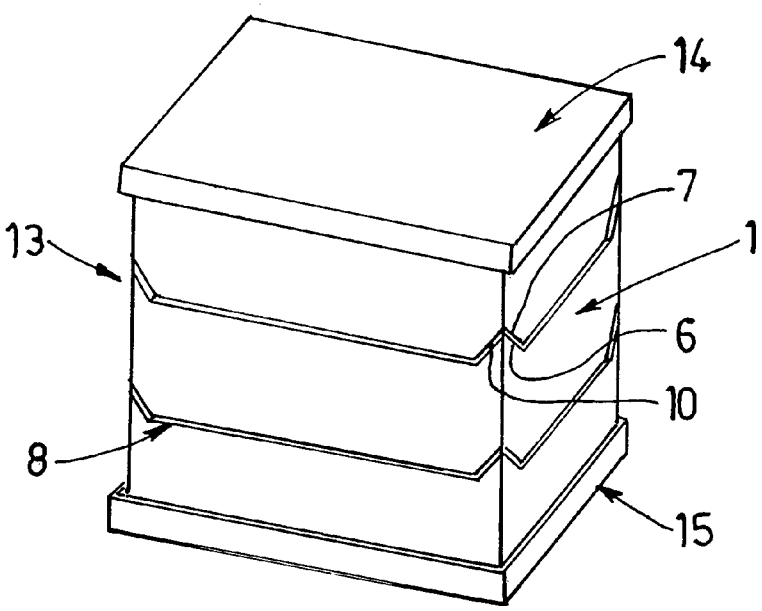
Figure 6:
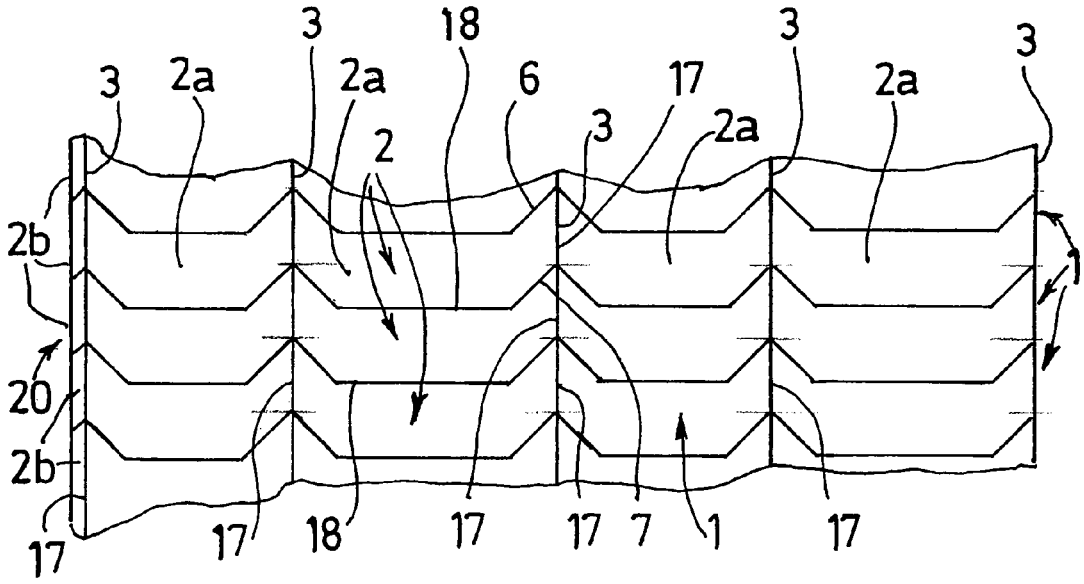
Figure 7:
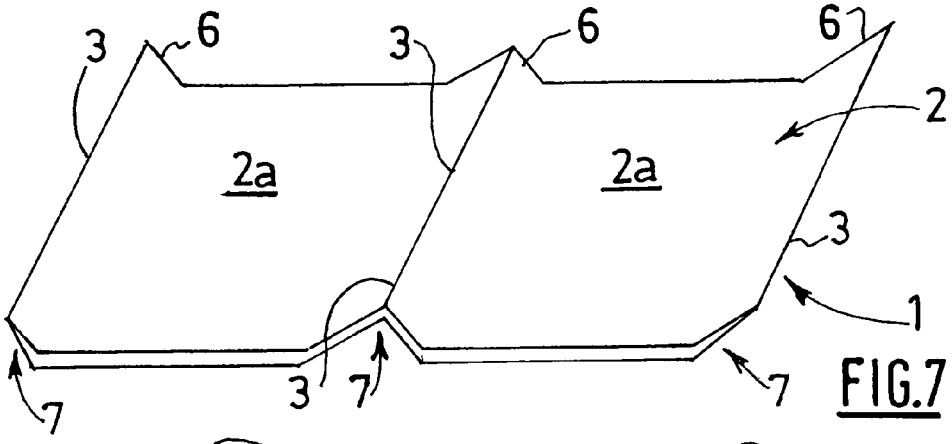
Figure 8A:
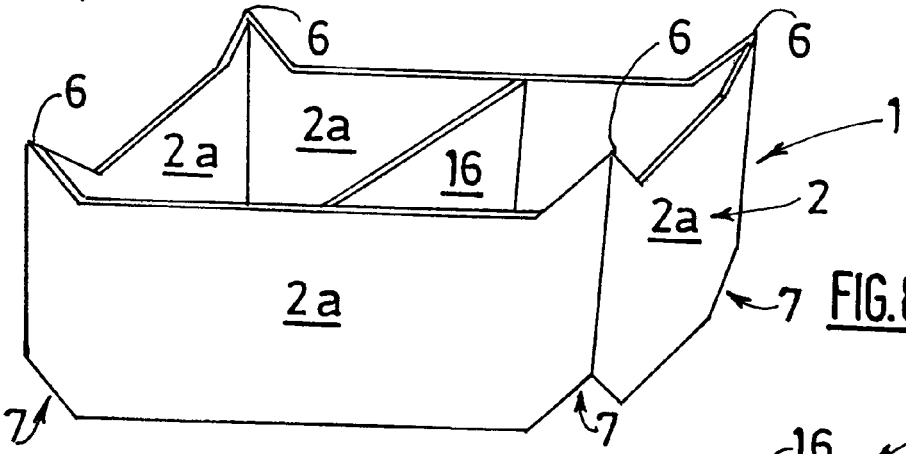
Figure 8B:
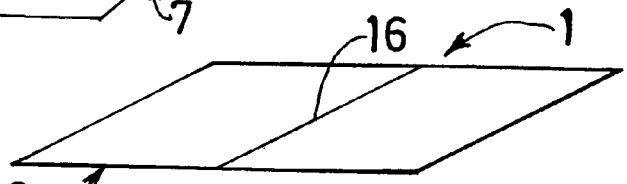
Figure 9A:
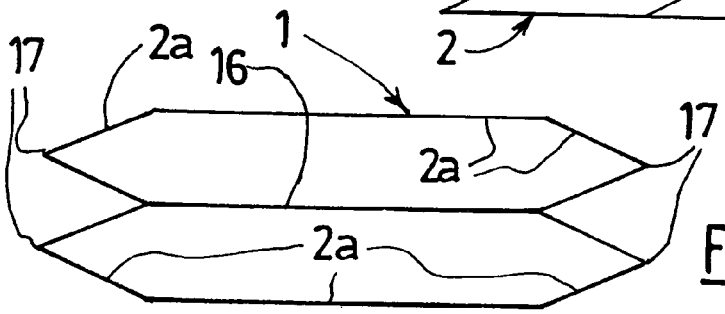
Figure 9B:
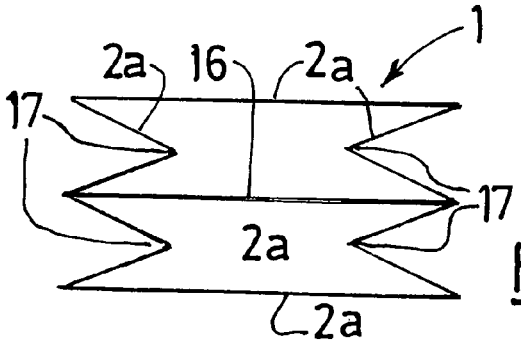
Figure 10:
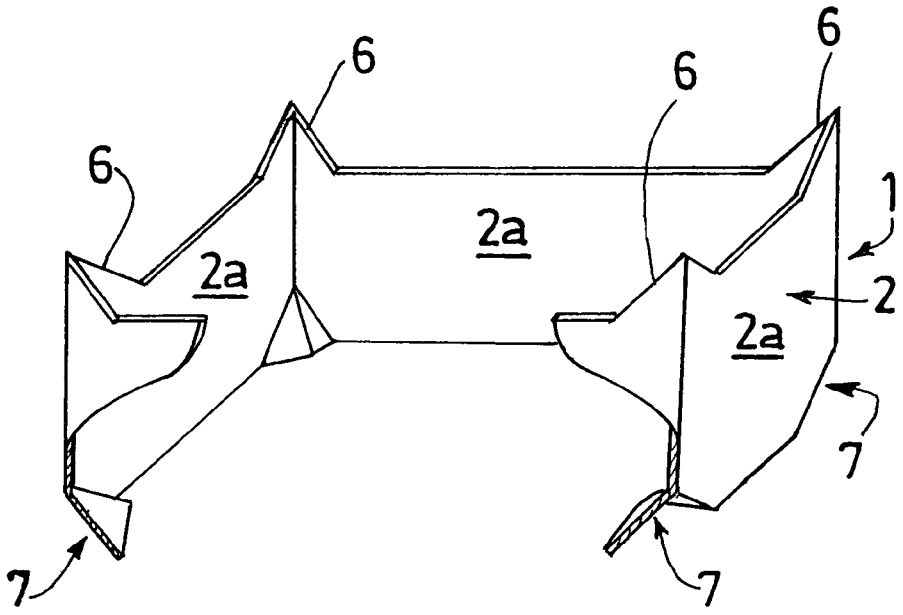
Figure 11:
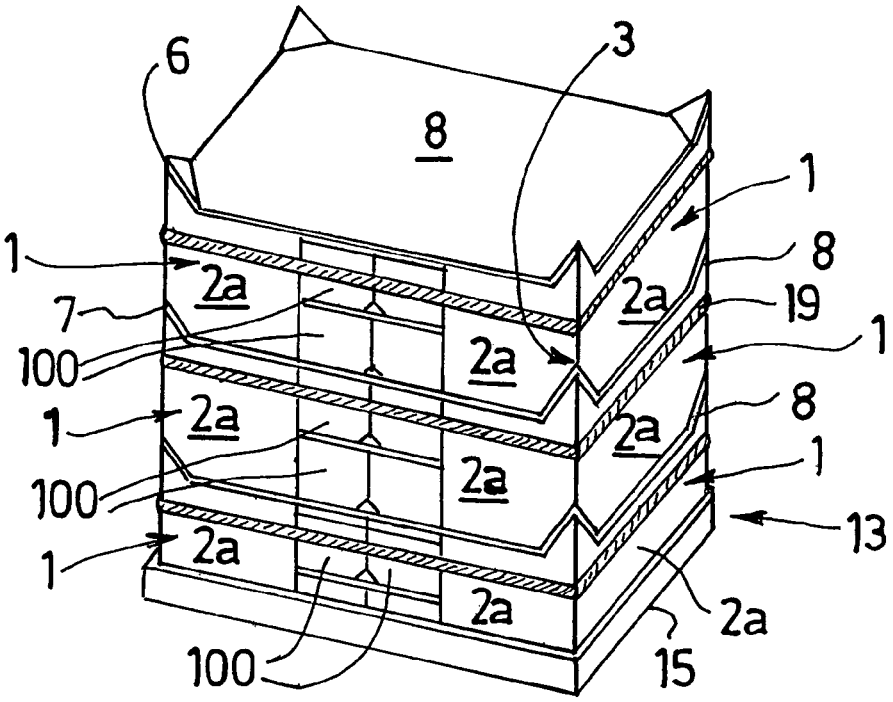
Figure 12A:
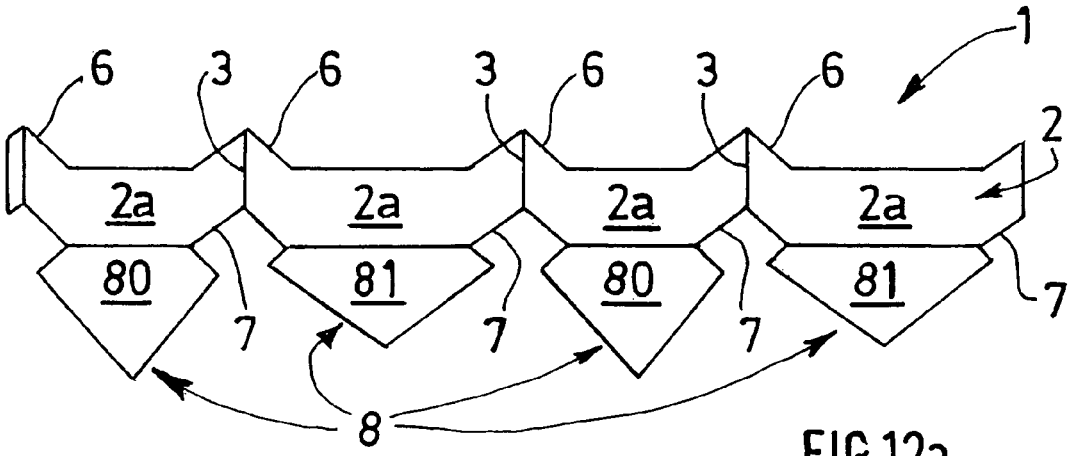
Figure 12B:
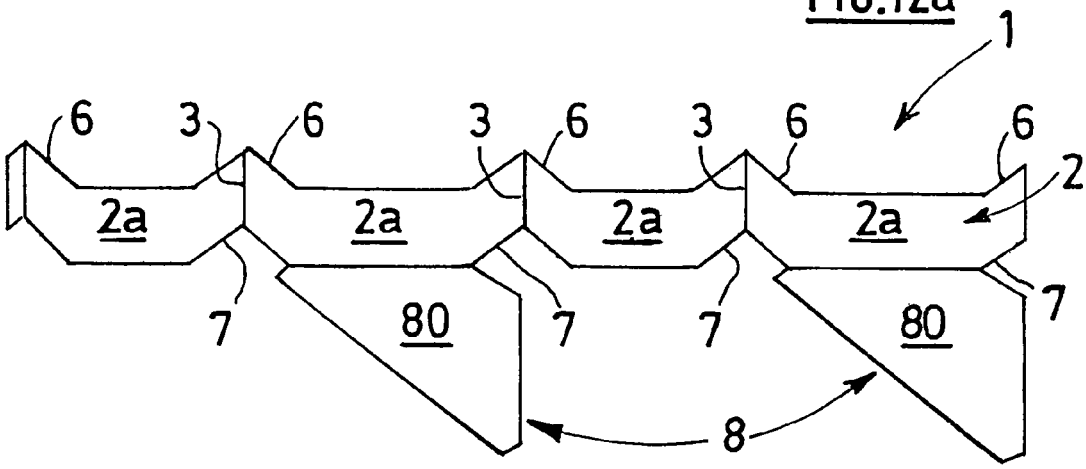
Figure 12C:
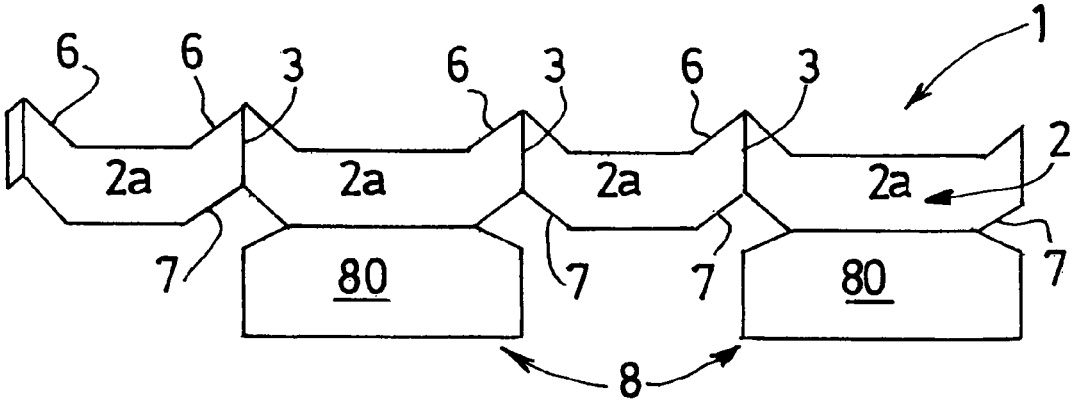

The present invention will now be described in greater detail with the aid of the description which follows and of the appended drawings in which:

FIG. 1 is a perspective view a packaging unit according to the invention,

FIG. 2 is a perspective view of an intermediate element intended to be used in combination with at least one packaging unit according to the invention, FIG. 3 is a view from above of the intermediate element of FIG. 2, FIG. 4 is a partial magnified view from above of a corner of the intermediate element of FIG. 3, FIG. 5 is a perspective view of a packaging according to the invention obtained by stacking several packaging units, FIGS. 5*a*, 5*b*, 5*c* are partial views of several embodiments of packaging according to the invention, the packaging units being separated by an intermediate element, FIG. 6 is a view from above of a board comprising several formats of cutout that are ready to be cut out to form packaging units according to the invention, FIG. 7 is a perspective view of a variant of the packaging unit according to the invention, folded up into the storage position, FIG. 8*a* is a perspective view of a variant embodiment of a packaging unit according to the invention, FIG. 8*b* is a diagrammatic view from above of the packaging unit of FIG. 8*a*, folded up into an intermediate position towards its storage position, FIGS. 9*a* and 9*b* are similar views to FIG. 8*b* for two variant embodiments of the packaging unit according to the invention, FIG. 10 is a partial perspective view of a variant embodiment of the packaging unit according to the invention, FIG. 11 is a perspective view of a variant embodiment of a packaging according to the invention, FIGS. 12*a*, 12*b*, 12*c* are views from above of several formats of cutout for making various packaging units according to the invention, integrating insert walls intended to form an intermediate element.

Represented in FIG. 1 is a packaging unit 1 according to the present invention. This packaging unit 1 comprises an encircling wall 2 forming a rectangle. The encircling wall 2 is closed on itself and forms a continuous enclosure open at its upper end and at its lower end. The packaging unit 1 thus comprises four vertical corner ridges 3 defining four retaining panels 2*a*. In this example, each corner ridge 3 comprises lower and upper ends joined to corresponding lower and upper edges of the retaining panels 2*a* by inclined centring profiles. To do this, the lower end of each corner ridge 3 is provided with a centring ridge 7 defining with the remainder of the corner ridge 3 a Y shape whose branches are arranged so as to truncate the corner formed by the intersection between the corner ridge 3 and the corresponding lower edges of the retaining panels 2*a*. In addition, the upper end of each corner ridge 3 is extended upwards by a centring projection 6 exhibiting a V shape of substantially complementary shape to that of the centring ridge 7. The centring ridge 7 of the packaging unit 1 of FIG. 1 is delimited by a cutout. As described hereinafter, the centring ridge 7 may also be delimited by a fold.

FIG. 2 represents an intermediate element in the form, in this example, of an intermediate tray 8 intended to be used in combination with one or more packaging units 1 of FIG. 1. This intermediate tray 8 exhibits a substantially plane, polygonal, rectangular shape complementary to that of the packaging unit 1. On at least a part of its contour, the intermediate tray 8 has exterior dimensions greater than the interior dimensions of the enclosure delimited by the packaging unit 1. Thus, the intermediate tray 8 can be located so as to bear against a packaging unit 1. In addition, when the intermediate tray 8 is placed against the packaging unit 1, it obturates at least a part of the opening delimited by the packaging unit 1.

The intermediate tray 8 is provided, at each of its corners 9, with a fold line 12 joined to the two adjacent sides of the intermediate tray 8 by slots 11. The fold lines 12 and the slots 11 define foldable tabs 10, intended to be in part raised or folded down so as to shape the intermediate tray 8. Thus, once it is bearing on the packaging unit 1, the intermediate tray 8 hugs the upper or lower relief of the packaging unit 1 and in particular of its inclined centring profile formed by its centring projection 6 and its centring ridge 7. The adjacent sides forming the corner 9 of the tab 10 define a linear centring wedge 4*a* intended to bear on the centring projection 6 or on the centring ridge 7 of the packaging unit 1. The edges, furthest from each corner 9, of the slots 11 define point-like centring wedges 4*b* intended to bear on the edge of the centring projection 6 or of the centring ridge 7 of the packaging unit 1. According to a variant embodiment represented partially in FIG. 5*b*, the centring projection 6 of the packaging unit 1 can comprise indentations 5 favouring the bearing of the point-like centring wedges 4*b* on the indentations 5 of the centring projection 6. Likewise, according to another embodiment (not represented), the centring ridge can comprise indentations favouring the bearing of the point-like centring wedges on the indentations of the centring ridge.

In an embodiment (not represented), the intermediate tray 8 is devoid of tabs 10 which have been cut out along the slots 11 and the fold lines 12, then removed. The intermediate tray 8 is thus devoid of linear centring wedges but still comprises the point-like centring wedges formed by the intersection of the edges of the intermediate tray 8 with the lines of slots 11.

In another embodiment (not represented), the packaging unit defines an enclosure whose shape is different from that of a rectangle, for example a triangle, a square, a hexagon or any other suitable shape and the intermediate element exhibits a substantially complementary corresponding shape. Likewise, the retaining panels 2*a* of the packaging unit 1 may or may not be vertical. By virtue of the complementary shapes of the centring projections 6, of the centring ridges 7 and of the tabs 10, several substantially identical packaging units 1 may, as described hereinafter, be easily placed adjacent to one another.

The packaging unit 1 is manufactured from a rigid material able to be prefolded along predetermined fold lines, in particular along the corner ridges 3 on the example represented. The material may be chosen from the group comprising paperboards, plastics and their mixtures. For example, a plastic that is ideally suited to the manufacture of the packaging unit 1 according to the invention is the plastic sold under the commercial brand name "AKILUX®" by the company Kaysersberg Packaging. Thus, as shown in FIG. 7 for a square variant of the packaging unit 1 of FIG. 1, the packaging unit 1 may be provided in a storage position, before use, two retaining panels 2*a* of the wall 2 being folded back over the other two retaining panels 2*a*, along two fold lines constituted by two opposite corner ridges 3. Each packaging unit 1 is easily unfolded so as to make it adopt the configuration of FIG. 1. After use, it is also easy to fold up the packaging unit 1 into the flattened storage configuration as is shown in FIG. 7 for a square variant of the packaging unit of FIG. 1. In a flattened storage configuration such as this, the packaging unit 1 is particularly compact. In addition, in their flattened storage configuration, the packaging units 1 are particularly easily handled and stored.

In the case where the products to be packaged are too fragile to be stacked one above the other and when each layer of products must be separated both from the adjacent lower layer and from the adjacent upper layer, it is indicated that packaging units 1 be provided whose height (according to FIG. 1) corresponds to that of the products to be packaged and, between each packaging unit 1, an intermediate tray 8 such as that represented in FIG. 2 be provided. Another solution can consist in using packaging units 1 whose height (according to FIG. 1) corresponds to two or three products to be packaged, then to dispose, between each layer of products, an intermediate board of smaller exterior dimensions than the interior dimensions of the packaging unit 1 into which it is slipped.

The intermediate tray 8 is preferably manufactured from the same material as the packaging unit 1. It may nevertheless be made from any other material. The intermediate tray 8 can be provided with a strengthening element (not represented), for example a bar glued along the width of the intermediate tray 8, passing through its centre, With reference to FIGS. 3 and 4 which show an intermediate tray 8 similar to that of FIG. 2, in the flat configuration, it is apparent that each tab 10 has the shape of a right-angled isosceles triangle whose two equal angles have been truncated along the slots 11, the triangle having thereafter been folded up along its hypotenuse corresponding to the fold line 12.

Thus, when a user decides to package products, such as for example boxes or tubs containing syringe bodies, he places a first packaging unit 1 on a support, for example a pallet, on which he disposes the products in one or more layers overlaid inside the enclosure delimited by the first packaging unit 1. As a function of the total desired height of packaging, the user can, at will, stack on the first packaging unit 1, one or more other packaging units 1, substantially similar to the first packaging unit 1 in which he disposes the products in successive layers. When the packaging units are disposed in an adjacent manner, for example overlaid, the centring projections 6 of each lower packaging unit 1 fit into the centring ridges 7 of each upper packaging unit 1. The specific inclined centring profile, as an inclined triangle of the centring projections 6 and of the centring ridges 7, at the level of the corner ridges 3, makes it possible to effect perfect self-centring of the packaging units 1 with respect to one another, the packaging units 1 then being perfectly aligned and centred with respect to one another.

According to another mode of implementation, the user can also dispose the products in several layers before surrounding them with the packaging units 1 placed, one by one or in a grouped manner, over the top of the stacks of products to be packaged. The packaging units 1 thus stacked may have mutually differing heights, for example to make it possible to stack layers of products of different heights. The packaging units 1 may also be used in an adjacent manner, placed side by side and not overlaid one above the other. The user can also use packaging units 1 in combination with intermediate elements of tray type 8 such as represented in FIG. 2. Thus, as may be seen from FIGS. 5 and 5*b*, when an intermediate tray 8 of FIG. 2 is inserted between two adjacent packaging units 1, namely for example a lower packaging unit 1 and an upper packaging unit 1, the tabs 10 of the intermediate tray 8 fit between the centring projection 6 of the lower packaging unit 1 and the centring ridge 7 of the upper packaging unit 1. The specific inclined centring profile, triangle-like, of the centring projections 6 and of the centring ridges 7 at the level of the corner ridges 3, and of the tabs 10 in the corners 9 of the intermediate tray 8, makes it possible to effect perfect self-centring of the three pieces with respect to one another, namely the lower packaging unit 1, the intermediate tray 8 and the upper packaging unit 1, which are then perfectly aligned and centred with respect to one another.

In the case of an intermediate tray 8 whose tabs 10 are in particular defined by slots 11 such as represented in FIG. 4, once the intermediate tray 8 has been placed between two packaging units 1, lower and upper, the linear 4*a* and point-like 4*b* centring wedges bear against the centring projection 6 of the packaging unit and against the centring ridge 7 of the upper packaging unit, thereby further improving the efficacy of the centring and its stability over time, in particular during movement of the packaging 13 thus constituted.

Represented in FIG. 5 is a packaging 13 comprising a stack of three packaging units 1 such as represented in FIG. 1 and of two intermediate trays 8 of FIG. 2.

The packaging 13 of FIG. 5 is moreover closed at its upper end by a cover 14 and at its lower end by a bottom 15. Such packaging 13 is intended to be loaded onto a pallet (not represented) with a view to being transported from one place to another. This packaging can thereafter be consolidated by means of an encircling (not represented) formed by one or more ties placed around the packaging units and possibly the pallet, the cover 14 and the bottom 15. In a conventional manner, this encircling may also be effected by means of a plastic film wound around the packaging 13. As is clearly apparent from FIG. 5, the whole set of packaging units 1 and of intermediate trays 8 forming the packaging 13 are perfectly aligned and centred one above the other and constitute a vertical stack making it possible to optimize and to automate the operations of handling, loading, unloading, of the packaged products, of the packaging units 1, of the intermediate trays 8, of the packages and of the loaded pallets. The relative alignment and relative centring of the packaging units 1 and of the intermediate trays 8 are facilitated and guaranteed by the specific inclined centring profile, triangle-like of the centring projections 6 and of the centring ridges 7 at the level of the corner ridges 3, and of the tabs 10 in the corners 9 of the intermediate tray 8.

Specifically, when the intermediate tray 8 is disposed on a packaging unit 1 and therefore when the linear centring wedge 4*a* of the tab 10 bears on the centring projection 6, the inclined centring profile, triangle-like of the centring projection 6 and of the tab 10, tends to bring about the movement of the intermediate tray 8 towards the centring projection 6 diagonally opposite the packaging unit 1. This diagonally opposite centring projection 6 acting in an opposite manner in cooperation with the tab 10 of the intermediate tray 8 corning to bear on the former, the intermediate tray 8 is self-centred, in a reliable manner, with respect to the packaging unit 1 on which it is placed. The same holds for the other two centring projections 6.

Likewise, when a packaging unit 1 is overlaid on the intermediate tray 8 previously placed on the preceding packaging unit 1, and hence when the centring ridge 7 bears on the linear centring wedge 4*a* of the tab 10, the triangle-like inclined centring profile of the centring ridge 7 and of the tab 10 tends to bring about the movement of the packaging unit 1 towards the diagonally opposite tab 10 of the intermediate tray 8. This diagonally opposite tab 10 acting in an opposite manner in cooperation with the centring ridge 7 which comes to bear on it, the packaging unit 1 is self-centred, in a reliable manner, with respect to the intermediate tray 8 on which it is placed. The same holds for the other two centring ridges 7 coming to bear on the other two tabs 10 of the intermediate tray 8.

The intermediate trays 8 and the packaging units 1 thus self-centring themselves perfectly when they are overlaid makes it possible to automate in particular the operations of stacking the intermediate trays 8 using automatic means such as for example robotized arms.

According to another embodiment, the first packaging unit 1 is disposed in such a way that its centring projections 6 are oriented downwards (and no longer upwards) and that its centring ridges 7 disposed upwards (and no longer downwards), the other packaging units 1 being stacked oriented in this same sense.

Represented in FIG. 5*a* is the nesting of a centring projection 6 of a lower packaging unit 1 according to FIG. 1, of a tab 10 of an intermediate tray 8 with no slot and of a centring ridge 7 of an upper packaging unit 1 according to FIG. 1. This FIG. 5*a* makes it possible to view the linear centring wedge 4*a* bearing respectively on the centring projection 6 and the centring ridge 7.

Represented in FIG. 5*b* is the nesting of a centring projection 6 of a lower packaging unit 1 similar to that of FIG. 1 comprising in addition indentations 5, of a tab 10 of an intermediate tray 8 according to FIGS. 2, 3 and 4 comprising in addition to the linear centring wedge 4*a*, slots 11 defining, when the tab 10 is raised or folded down, so-called point-like centring wedges 4*b*. In this figure, the upper packaging unit 1 (not represented) may also comprise indentations so as to cooperate with the point-like centring wedges 4*b*. This FIG. 5*b* makes it possible to view the linear centring wedge 4*a* bearing on the centring ridge 7 and likewise, the point-like centring wedges 4*b* bearing on the indentations 5.

Represented in FIG. 5*c* is the nesting of a centring projection 6 of a lower packaging unit 1, of a tab 10 of an intermediate tray 8 and of a centring ridge 7 of an upper packaging unit 1 in the case where the centring profile and hence the shape of the centring projection 6 is a half-disk. In this case, the tab 10 is also in the shape of a half-disk, folded back over itself along its diameter. The centring ridge 7 is a hollow shape corresponding likewise to a half-disk.

Represented in FIG. 6 is a board 20 of a material intended to be cut out as cutout formats so as to constitute packaging units 1 according to the invention. On this board 20 three cutout formats for constituting three packaging units 1 according to FIG. 1 are visible. For each unit 1, the cutout format comprises predetermined fold lines 17 corresponding to the corner ridges 3 of each future packaging unit 1 and cutout lines 18 intended to allow the mutual separation of the packaging units 1. Each cutout format defines, between the fold lines 17 four future retaining panels 2*a* as well as a flange 2*b* intended to allow the joining of the two ends of the cutout format, for example by gluing, so as to define a closed enclosure of each packaging unit 1. As is clearly apparent from this FIG. 6, the cutout format of each packaging unit 1 being complementary to that of the adjacent packaging unit 1, an economy of material is achieved during the manufacture of the packaging units 1 by avoiding droppages of scrap material.

FIG. 8*a* represents a packaging unit 1 according to a variant embodiment of the invention, this packaging unit 1 being substantially similar to that of FIG. 1. It is differentiated therefrom by the fact that it furthermore comprises a strengthening element 16 formed by a wall, of substantially similar height to that of the retaining panels 2*a* in their mid-part and disposed substantially vertically in the middle of the two longitudinal retaining panels 2*a*. The strengthening element 16 may or may not be fixed to the adjacent retaining walls 2*a*. Thus, when the intermediate tray (not represented in this figure) is disposed on the packaging unit 1, its central part rests on the strengthening element 16, thus preventing the weight of the products disposed on the intermediate tray from being transferred onto the products previously placed underneath. FIG. 8*b* represents diagrammatically, viewed from above, the packaging unit 1 with the strengthening element 16 fixed to the adjacent retaining panels 2*a*, the whole being in a prefolded position.

FIGS. 9*a* and 9*b* diagrammatically represent, viewed from above, two variant embodiments of packaging units in the prefolded position, each packaging unit 1 being provided with a strengthening element 16.

With reference to FIGS. 9*a*, 9*b*, two of the retaining panels 2*a* of the packaging unit 1 exhibit additional fold lines 17 respectively "external" and "internal" enabling the other two retaining panels 2*a* to be brought towards one another.

FIG. 10 represents a packaging unit 1 substantially similar to that of FIG. 1. It is differentiated therefrom by the fact that the centring ridges 7 are not delimited here by cutouts but by inward folds of the lower end of the corner ridges 3. This packaging unit 1 is used in a substantially similar manner to that of FIG. 1.

FIG. 11 represents a packaging 13 comprising a stack of three packaging units 1. Each packaging unit 1 comprises two open encircling walls 2 each forming viewed from above a U and disposed straddling the products 100. In this example, the products 100 are disposed, between each intermediate tray 8, as two overlaid layers. Each encircling wall comprises two corner ridges 3 delimiting three retaining panels 2*a* partially folded down towards one another, two centring projections 6 and two centring ridges 7. These packaging units 1 are used in a substantially similar manner to that of FIG. 1 except for the fact that they must be retained in position by means of one or more encircling elements 19, for example a flexible tie tightening them around the products 100.

According to a variant embodiment not represented, each packaging unit comprises four open encircling walls each forming viewed from above a V and each disposed in an angle delimited by the group of products to be packaged. Each encircling wall comprises a corner ridge delimiting two retaining panels, a centring projection and a centring ridge. These packaging units are used in a substantially similar manner to that of FIG. 11.

In the example of FIG. 12*a*, the packaging unit comprises two pairs of insert walls 80, 81, each insert wall 80, 81 of each pair being respectively attached, some to a lateral retaining panel 2*a*, others to a longitudinal retaining panel 2*a*. These insert, walls 80, are substantially in the shape of an isosceles triangle, the corners of whose equal sides joined to the base are truncated so as to allow the passage of the projection 6 of another packaging unit 1 disposed in an adjacent manner.

In the example of FIG. 12*b*, the packaging unit 1 comprises two insert walls 80 each attached to the lateral or longitudinal retaining panels 2*a*. These insert walls 80 are substantially in the shape of a right angled triangle whose corners are truncated so as to allow the passage of the projection 6 of another packaging unit 1 disposed in an adjacent manner.

In the example of FIG. 12*c*, the packaging unit 1 comprises two insert walls 80 each attached to the lateral or longitudinal retaining panels 2*a*. These insert walls 80 are substantially in the shape of a rectangle whose corners adjacent to the retaining panels 2*a* are truncated so as to allow the passage of the projection 6 of another packaging unit. I disposed in an adjacent manner.

These examples are not limiting and the packaging unit may be associated with one or more insert walls of any shape that are intended, after shaping of the packaging unit to form an insert element occupying all or part of the opening delimited by the packaging unit.

The packaging unit, the intermediate element and the packaging according to the invention afford definite advantages with respect to the packagings of the prior art. The inclined centring profile of the centring projections and of the centring ridges makes it possible to achieve perfect self-centring of the packaging units with respect to one another. Likewise, the specific shape of the inclined tabs makes it possible, in collaboration with the inclined centring profiles, to achieve perfect relative self-centring of the packaging units and of the intermediate elements. The packaging units and intermediate elements according to the invention are thus easy to use and may be positioned with respect to one another in an automatic and reliable manner. The packaging units according to the invention make it is possible to avoid wastage of material. The packagings according to the invention make it possible to guarantee good stability and good alignment of the packaged products during their transport and their storage.

The invention claimed is:

1. Stackable packaging unit (1) for the packaging of products (100), the said packaging unit (1) comprising at least one encircling wall. (2) provided at least with a corner ridge (3) dividing it into at least two retaining panels (2*a*) partially folded down towards one another about the said corner ridge (3) so as to hold the said products (100) to be packaged, at least one end of the said corner ridge (3) being connected to the corresponding edges of the said retaining panels (2*a*) by at least one inclined centring profile chosen from among a centring ridge (7) defining with the said corner ridge (3) a substantially Y shape whose branches are arranged so as to truncate the corner formed by the intersection between the said corner ridge (3) and the corresponding edges of the said retaining panels (2*a*), and a centring projection (6) extending the said corner ridge (3) and exhibiting a substantially V shape of substantially complementary shape to that of the said centring ridge (7), said packaging unit (1) further comprising at least one intermediate element (8) comprising at least one substantially plane insert wall (8, 80. 81) of polygonal shape, the said insert wall (8, 80, 81) being intended to be disposed so as to bear against at least one of said centring ridge (7) or centring projection (6) of the said packaging unit (1), a fold line (12) extends across at least one corner (9) of said intermediate element (8) so as to define a planar tab (10) foldable about said fold line (12) in a planar state, said tab (10) defining the at least one corner (9) of said intermediate element (8) and at least one linear centring wedge (4*a*) configured to bear directly against at least a part of the said centring ridge (7) or centring projection (6), a profile of the at least one linear centring wedge (4*a*) of said tab, as viewed in a direction perpendicular to the plane of said tab, is substantially of the same shape as an inclined centring profile defined by one at least of the said centring projection (6) or centring ridge (7), characterized in that at least one of the said retaining panels (2*a*) is extended by at least one insert wall (80, 81) defining at least in part the said intermediate element (8), said packaging unit (1) being able to adopt a flattened storage configuration in which at least two of the said retaining panels (2*a*) that are adjacent are folded back towards one another about the said corner ridge (3) separating them.

2. Packaging unit (1) according to claim 1, characterized in that said intermediate element (8) is manufactured from a material chosen from the group comprising paperboards, plastics and their mixtures.

3. Packaging unit (1) according to claim 1, characterized in that several retaining panels (2*a*) are each extended by at least one insert wall (80, 81), the said insert walls (80, 81) being arranged so as to completely shut off an opening of the enclosure delimited by the said packaging unit (1).

4. Packaging (13) characterized in that it comprises at least two packaging units (1) according to claim 1, the said packaging units (1) being adjacent and nested one in another by means of the said centring projection (6) of a first packaging unit (1) lodged against the said centring ridge (7) of a second adjacent packaging unit (1), at least one intermediate element (8) being disposed nested between the said first and second adjacent packaging units (1).

5. Packaging (13) according to claim 4, characterized in that it furthermore comprises a cover (14).

6. Packaging (13) according to claim 4, characterized in that it furthermore comprises a transport pallet.

7. Assembly of products (100) disposed in adjacent stacks and packaged by means of a packaging (l3) according to claim 4.

* * * * *